US006406340B1

(12) United States Patent
Fetchko et al.

(10) Patent No.: US 6,406,340 B1
(45) **Date of Patent: *Jun. 18, 2002**

(54) TWIN OUTBOARD MOTOR HYDRAULIC STEERING SYSTEM

(75) Inventors: Eric Fetchko; Andrew McFadyen, both of Richmond; Dana Trousil, Vancouver, all of (CA)

(73) Assignee: Teleflex (Canada) Limited, Richmond (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/012,796

(22) Filed: Jan. 23, 1998

(51) Int. Cl.[7] ..... B63H 20/12
(52) U.S. Cl. ..... 440/61; 440/63
(58) Field of Search ..... 440/61, 63, 62

(56) References Cited

U.S. PATENT DOCUMENTS 2,961,986 A * 11/1960 Rockhill ..... 440/63
4,009,678 A * 3/1977 North ..... 440/62
4,773,882 A * 9/1988 Rump ..... 440/61
4,836,812 A * 6/1989 Griffiths ..... 440/62
5,092,801 A * 3/1992 McBeth ..... 440/61

FOREIGN PATENT DOCUMENTS

JP 8-276896 * 10/1996

* cited by examiner

*Primary Examiner*—Sherman Basinger
(74) *Attorney, Agent, or Firm*—Norman M. Cameron

(57) ABSTRACT

A hydraulic steering assembly applies a force to a tiller arms of twin marine, outboard propulsion units and rotates the propulsion units about a steering axis between a center position and hard over positions to each side of the center position. Each propulsion unit is supported for arcuate movement about a tilt axis which is generally perpendicular to the steering axis. There is a hydraulic steering apparatus mounted on a first of the propulsion units which includes a hydraulic cylinder pivotally connected to a member which is pivotally mounted on the tiller arm of the first propulsion unit. A tie-bar is pivotally connected to the steering apparatus and pivotally connected to the tiller arm of a second propulsion unit. For example, the tie-bar may be pivotally connected to the steering apparatus by a ball joint connected to the steering apparatus by a bracket which moves with the member.

5 Claims, 11 Drawing Sheets

TWIN OUTBOARD MOTOR HYDRAULIC STEERING SYSTEM

This invention relates to hydraulic steering assemblies for outboard marine motors and, in particular, to steering systems for twin outboard motors.

BACKGROUND OF THE INVENTION

Hydraulic steering systems for marine craft having outboard motors are well known and desirable accessories. Conventionally such steering systems have a steering wheel located remotely from the engine. A hydraulic pump is located on the steering wheel and is hydraulically connected to a steering assembly by hydraulic lines. A steering apparatus is mounted on the outboard propulsion unit, or one or more of the units in the case of marine craft having a plurality of outboard propulsion units, and includes a hydraulic cylinder with a piston rod which reciprocates and thus steers the propulsion unit about a steering axis. A tie-bar typically connects the steering apparatus to the second propulsion unit in the case of craft having twin propulsion units.

U.S. Pat. No. 4,373,920 to Hall et al., teaches that the traveling cylinder can be attached to the tiller arm by a slider mechanism wherein a lost motion connection is established between the tiller arm and the cylinder in order to compensate for the arcuate movement of the tiller arm. Alternatively, a drag link mechanism can be pivotally attached between one end of the cylinder and the tiller arm. These mechanisms have certain limitations discussed in U.S. Pat. No. 5,092,801 to McBeth.

McBeth discloses a connector which provides a strong and simple universal connection between the hydraulic steering assembly and the tiller arm of the engine. This eliminates a lost motion type slider. However, the mechanism requires significant rotation of the support brackets about the tilt axis of the motor. This rotation may be inhibited by such factors as poor maintenance, including the overtightening of nuts and other components or by corrosion, for example. If the support brackets are thus inhibited from rotating, then the steering action is impaired. This possibility has prevented widespread commercial acceptance of the McBeth steering assembly, even though it appears to provide significant advantages over the prior art.

Additional problems are encountered with hydraulic steering systems for twin outboard motors since the motors must be capable of tilting independently about the tilt axis. Conventionally tie-bars are connected to outer holes of the tillers or to plates attached to the tiller. Both systems take up considerable space, particularly the latter, with accompanying potential to interfere with other components such as transoms and splashwells. Also damage can result from excessive toe in of one or both motors when one of them is tilted up.

It is therefore an object of the invention to provide an improved hydraulic steering assembly for twin outboard motors which overcomes disadvantages associated with the prior art.

It is also an object of the invention to provide an improved hydraulic steering assembly for twin outboard motors which reduces significantly rotation of the support brackets about the tilt axis of the motor, thus allowing continued steering even when rotation of the brackets is impaired.

It is a further object of the invention to provide an improved steering assembly for twin outboard motors which reduces toe in (rotation of one or both motors about the steering axes) as one motor is tilted up.

It is a still further object of the invention to provide an improved hydraulic steering assembly for twin outboard motors which is simple and reliable in construction and is relatively easy to install and maintain.

SUMMARY OF THE INVENTION

According to one aspect of the invention there is provided a hydraulic steering assembly for applying a force to tillers of two or more marine outboard propulsion units and, accordingly rotating each propulsion unit about a steering axis about a steering axis between a center position and hard over positions to each side of the center position. The propulsion units are supported for arcuate movement about a tilt axis which is generally perpendicular to the steering axis. The steering assembly includes a hydraulic steering apparatus mounted on a first propulsion unit which includes a hydraulic cylinder pivotally connected to a member which is pivotally mounted on the tiller of the first propulsion unit. A tie-bar is pivotally connected to the steering apparatus and pivotally connected to the tiller arm of a second said propulsion unit.

According to another aspect of the invention, there is provided a hydraulic steering assembly for applying a force to tillers of two or more marine, outboard propulsion units and, accordingly, rotating each said propulsion unit about a steering axis between an center position and hard over positions to reach side of the center position, the propulsion units being supported for arcuate movement about a tilt axis which is generally perpendicular to the steering axis. The steering assembly comprises a hydraulic steering cylinder and an elongated piston rod reciprocatingly mounted within the cylinder for movement along a piston rod axis. A pair of support arms are pivotable about the tilt axis of a first propulsion unit and are connected to the piston rod. They allow arcuate movement of the rod about the tilt axis, while maintaining the rod parallel to the tilt axis. A member is pivotally mounted on the tiller of the first propulsion unit for pivoting about a first link axis which is parallel to the steering axis. A cylinder arm is connected to the cylinder and extends radially outwards from the piston rod axis. The cylinder arm is pivotally connected to the member for pivoting about a second link axis which is parallel to the piston rod axis. The cylinder arm moves through a rotational position, when the first propulsion rotates from the center position to either hard over position. The second link axis and the rod axis are on a plane parallel to the steering axis of the first propulsion unit. A tie bar is pivotally connected to the member and to a second said propulsion unit.

BRIEF DESCRIPTION OF THE DRAWINGS

In the drawings:

FIG. 3*b* is a view similar to FIG. 4*a* and optimum position for the tie-bar toe-in;

DETAILED DESCRIPTION OF THE PREFERRED EMBODIMENTS

Figure 1:
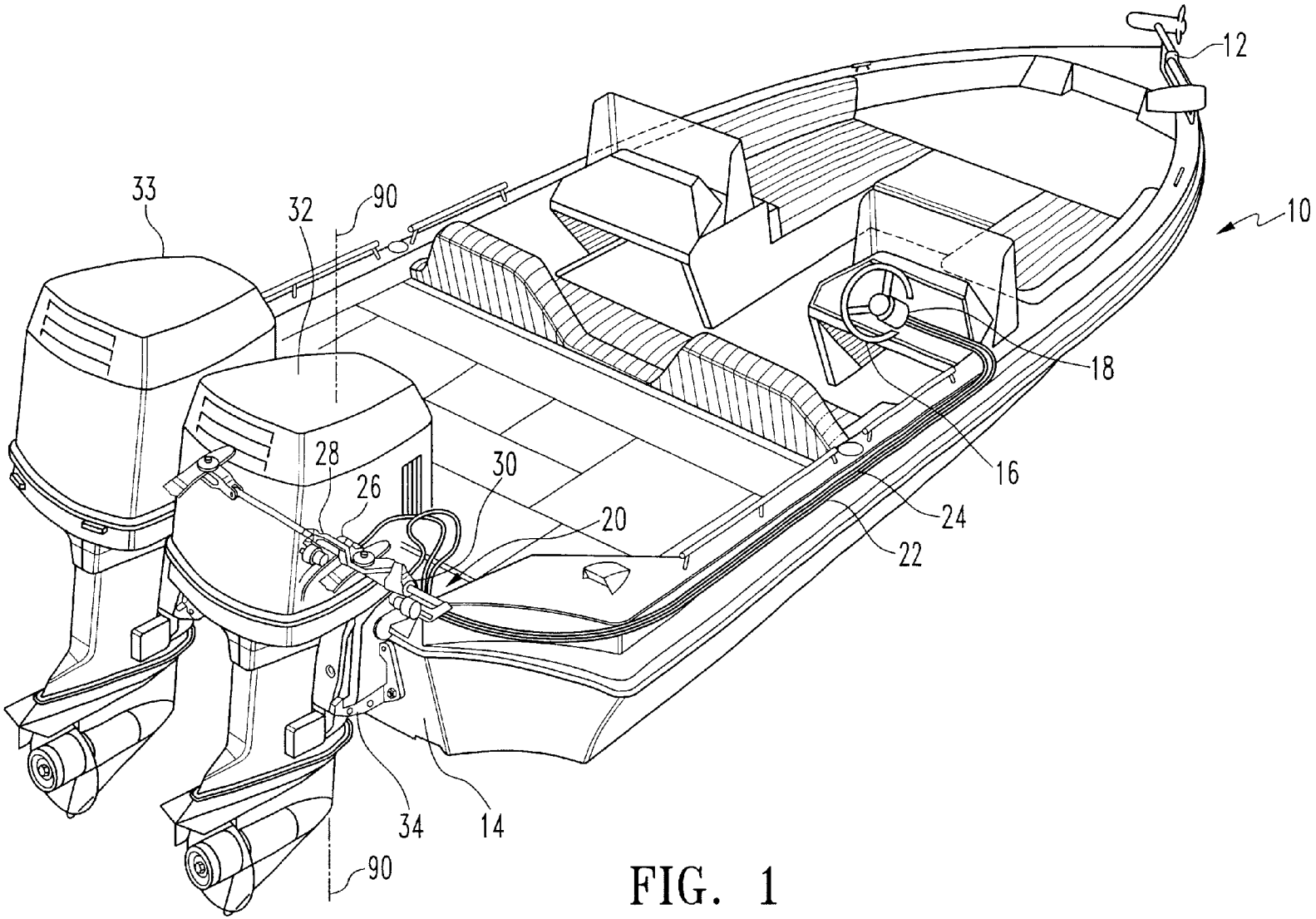
FIG. 1 is a top, rear isometric view of a boat fitted with twin outboard motors and a hydraulic steering system according to an embodiment of the invention.
Figure 2:
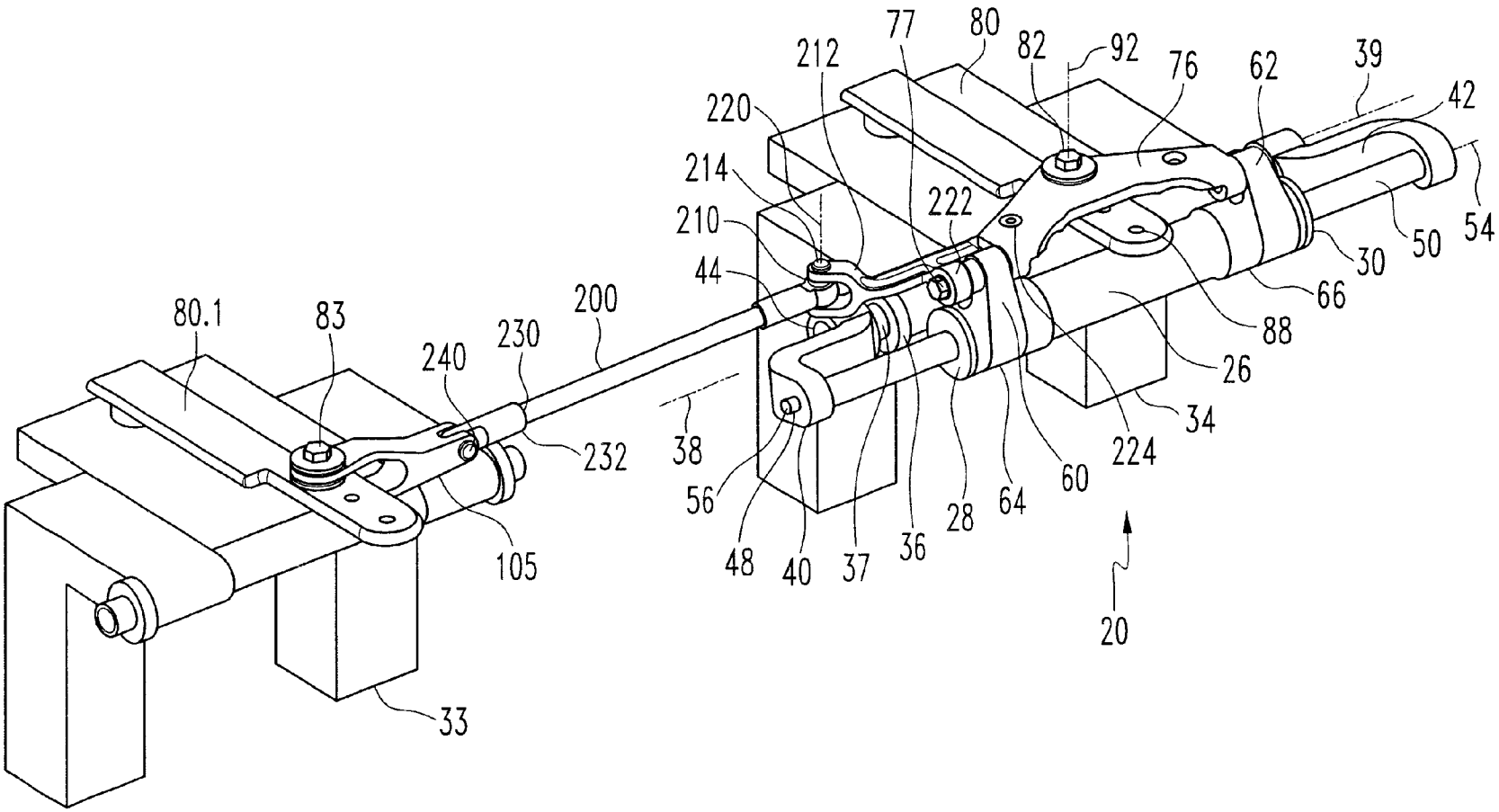
FIG. 2 is a top, front isometric view of a steering system according to an embodiment of the invention, the positions of the motors being interchanged compared to FIG. 1.

Referring to the drawings, and first to FIG. 1, this shows a boat 10 which is generally conventional and, accordingly, is only described briefly. The boat has a bow 12 and a stern 14. There is a steering wheel 16 fitted to a hydraulic pump 18. The pump 18 is hydraulically connected to a hydraulic steering apparatus 20 by two hydraulic lines 22 and 24. The steering apparatus includes a steering cylinder 26 with opposite ends 28 and 30. Hydraulic line 24 is connected to the end 30, while hydraulic line 22 is connected to end 28. The steering system is mounted on a conventional outboard motor 32 having a mid section 34 shown in better detail in the fragmentary view of FIG. 2. A second outboard motor 33 is mounted on the stern beside motor 32. FIG. 2 shows the positions of the cylinders and motors reversed compared to FIG. 1.

Midsection 34 of the motor 32 has a tilt tube 36 and a support rod 37 passing through the tube which allow the motor to be tilted about a tilt axis 38 from the running position shown in FIG. 1 to a tilted positions. A pair of support arms (or support brackets) 40 and 42 are mounted on opposite ends of the support rod. Each arm is somewhat z-shaped and has an aperture 44 receiving the rod. Each arm also has a second aperture 48 for connecting the arm to one end of piston rod 50 of the hydraulic cylinder 26. The piston rod is reciprocatingly mounted within the cylinder for relative movement along a piston rod axis 54. In fact the rod is axially stationary with respect to the boat while the cylinder reciprocates. The piston rod has a section 56 of reduced diameter received within the aperture 48 of each arm. The support arms allow arcuate movement of the piston rod 50 and cylinder about the tilt axis 38, while maintaining the rod axis 54 parallel to the tilt axis 38.

The cylinder 26 has of pair of cylinder arms 60 and 62 which extend radially outwards from the piston rod axis 54. In this particular example, the arms are integral with end fittings 64 and 66 of the cylinder adjacent its ends 28 and 30 respectively. Each of the cylinder arms has an aperture which receives a pivot pin on a pivot plate 76. The pin for arm 60 is in the form of a bolt 77. The pivot plate is pivotally mounted on the tiller arm 80 (also called a tiller herein) of the motor by means of tiller joint 82 which extends through an inner aperture of the tiller arm, shown in FIG. 4*a*. The tiller arm in the particular example also has an outer aperture 88, shown in FIG. 2. The inner aperture is closer to steering axis 90, shown in FIG. 1, than the outer aperture.

The tiller joint 82 pivotally mounts the pivot plate 76 on tiller arm 80 for pivoting about a first link axis 92 which is parallel to the steering axis 90. The joint in this example is the same as tiller joint 83 for motor 33 shown in FIG. 6*a* and includes a bolt 96 which threadedly receives the tiller arm 80.1. Like parts for motor 33 have like numbers with ".1" added. A washer bush 100 is fitted over the bolt between the tiller arm and top bar 103 of clevis 105 which is positioned on motor 33 as pivot plate 76 is on motor 32. The washer bush has a disk-shaped portion 102 connected to a sleeve-like portion 104 which contacts a washer 106 fitted between the head 97 of the bolt and the top bar or pivot plate. The length of the sleeve-like portion 104 provides a gap 110 between the washer 106 and tiller washer 114 resting against the top surface of the pivot plate.

The tiller washer 114 extends about the upper portion of resilient bushing 128 and aperture 130 of the tiller plate. The bushing should be stiff enough to transmit steering but permit limited tilting of the pivot plate relative to the tiller. In this example the bushing 128 is of acetal homopolymer although other polymers and other resilient and deformable materials could be substituted. This arrangement reduces torsional stresses on the clevis and the tiller arm. The components below the tiller arm are unique to motor 33 and are described below.

FIG. 2 shows the center position of the tiller arm which corresponds to steering the boat straight ahead. When hydraulic fluid is pumped into the cylinder from pump 18 through either hydraulic line 22 or 24, the motor 32 is steered towards one of the hard over positions for maximum steering. For example, when hydraulic fluid is pumped through hydraulic line 22, it moves the cylinder 26 and the tiller arm 80 to the right from the point of view of FIG. 2*a*. The maximum steering is achieved at the hard over position.

The cylinder arm 62, along with arm 60, pivots about the piston rod axis 54 from a position angled forwardly from the motor 32 when the motor is at the center position shown in FIG. 2 to a position angled rearwardly towards the motor in the hard over positions to each side thereof When moving from the center position of FIG. 2 to the hard over positions, the cylinder arm moves through a partly rotated position where the second link axis 39 and the piston rod axis 54 are on the plane which is parallel to the steering axis 90.

It has been found that this arrangement minimizes rotation of the support arms 40 and 42. Because rotation of the support arms is minimized, it has been found that the boat can still be steered even when the support rod 37 is inhibited or prevented from rotating in the tilt tube 36. The normal play in the other components of the steering assembly allows the motor to steer even when this occurs. In fact the system may be designed with zero rotation of the support arms for certain outboard motors.

The steering cylinder has a bleed fitting (not shown). In the hard over positions of FIG. 5*b* the fitting is at the highest point on the cylinder and is tilted upwards to ease bleeding air from the cylinder.

Figure 2A:
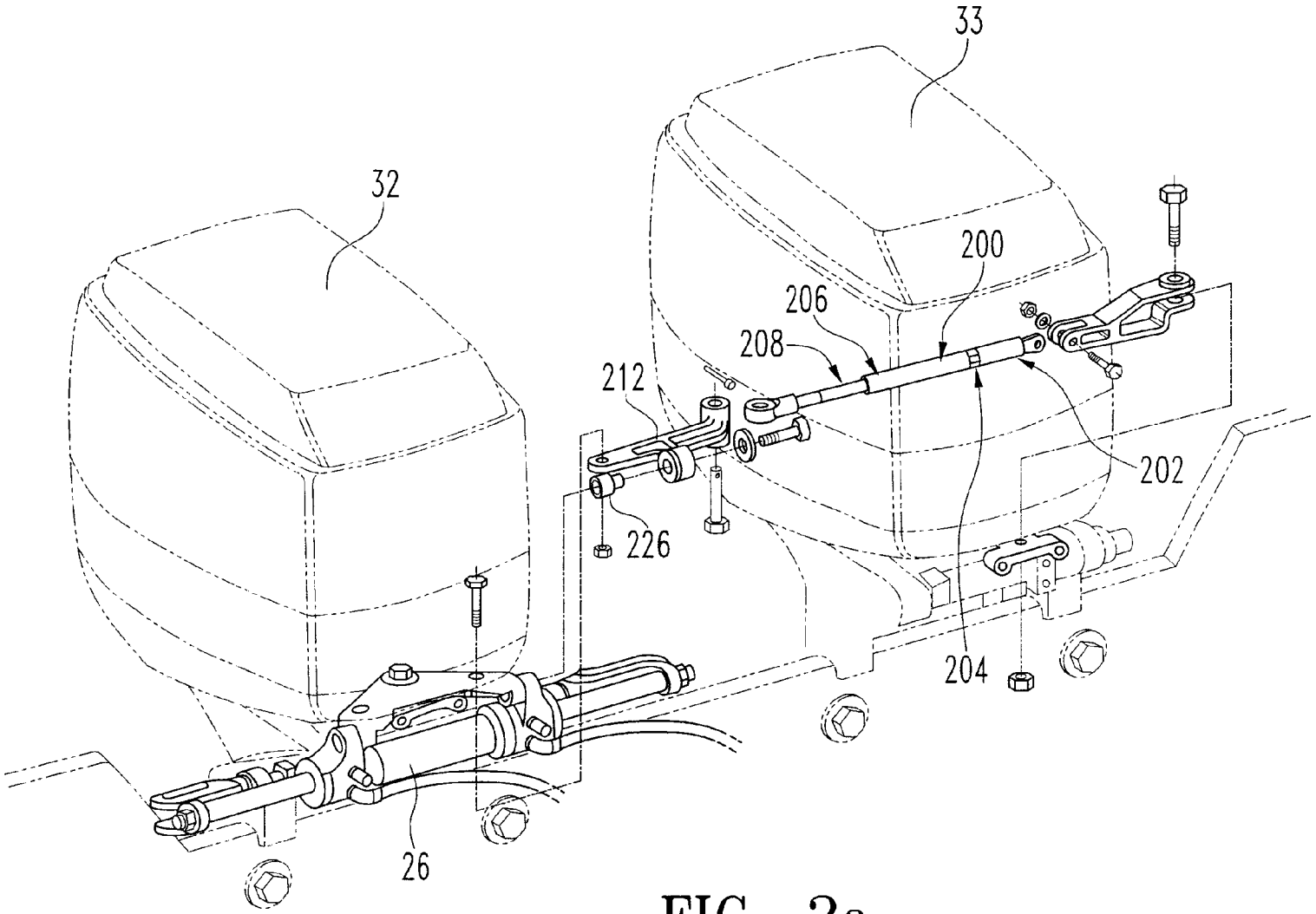
FIG. 2*a* is a top, front isometric view of the upper portions of the motors and an exploded view of the steering system.

There is a tie-bar 200, shown in FIGS. 2 and 2*a*, which is pivotally connected to the steering apparatus 20 and is also pivotally connected to tiller arm 80.1 of motor 33. The tie-bar 200 includes a rod end 202, a rut 204, a stringer tube 206 and a rod 208, shown in FIG. 2*a*.

The tie bar is pivotally connected to the steering apparatus by a ball joint 210. The ball joint is connected to the apparatus by a bracket 212 and a pivot pin 214 which permits pivoting about an axis 220 which is parallel to the steering axis 90 of the propulsion unit 32 shown in FIG. 1. The bracket 212 is connected to pivot plate 76 by bolt 77 which extends through eye 222 of the bracket. It is also connected to the bottom of the pivot plate by a threaded fastener 224. A spacer is fitted between the bracket and the bottom of the pivot plate in this example.

The tie-bar 200 has a threaded end 230 threadingly received by an end fitting 232 such that the tie-bar is axially rotatable with respect to the end fitting. The end fitting is pivotally connected to clevis 105 by a pivot pin 240. The clevis is connected to tiller arm 80.1 of the motor 33 by the tiller joint 83 described in part above. Some boats have cylinders on both engines and the tie-bar is connected to the steering apparatus of each.

Figure 6A:
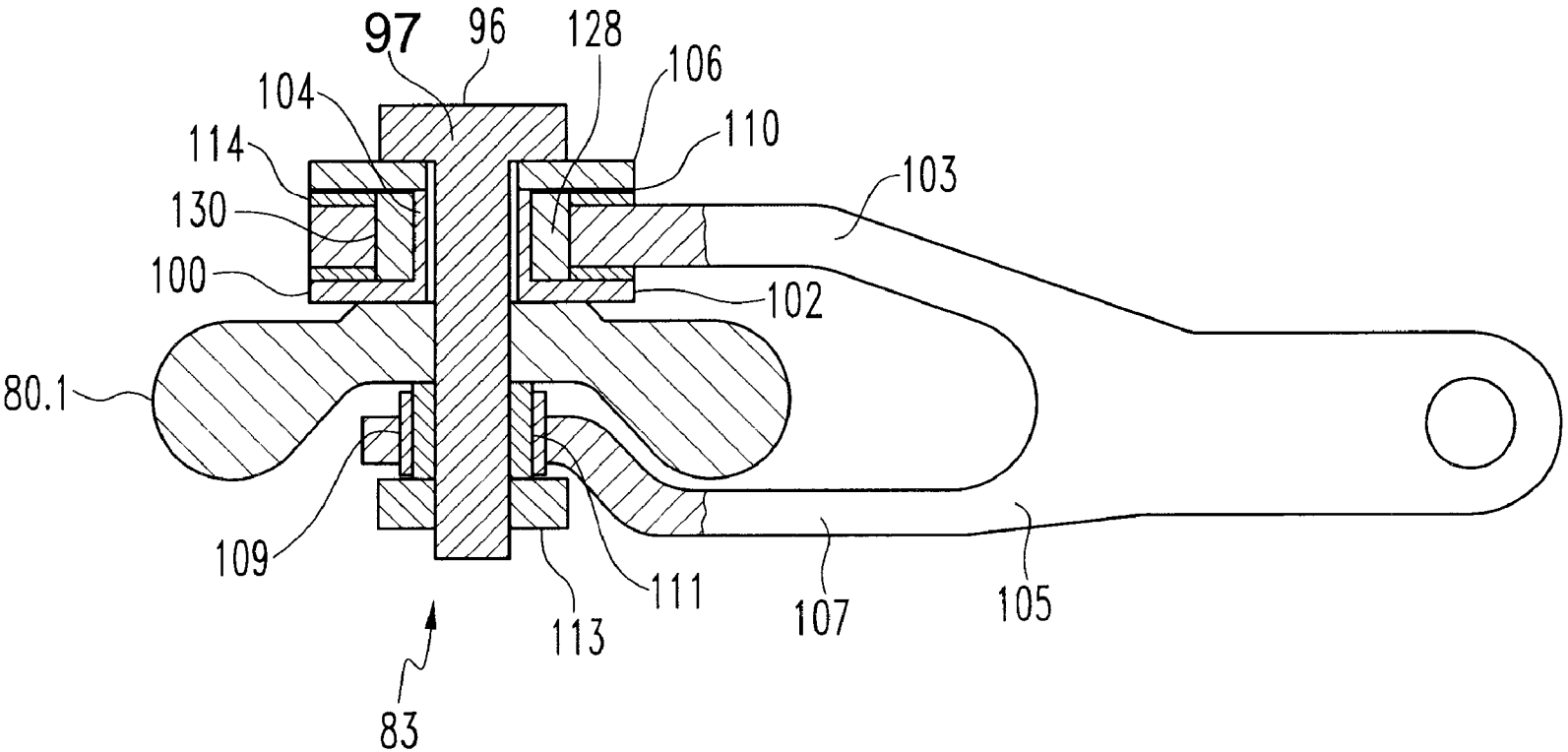
FIG. 6*a* is a side view of the clevis, partly in section, with the tiller arm and joint shown in section.

With reference to FIG. 6*a*, the clevis also has a bottom bar 107 and the bolt 96 passes through aperture 109 in the bottom bar as well. There is a bottom bush 111 and a stem nut 113.

Figure 6C:
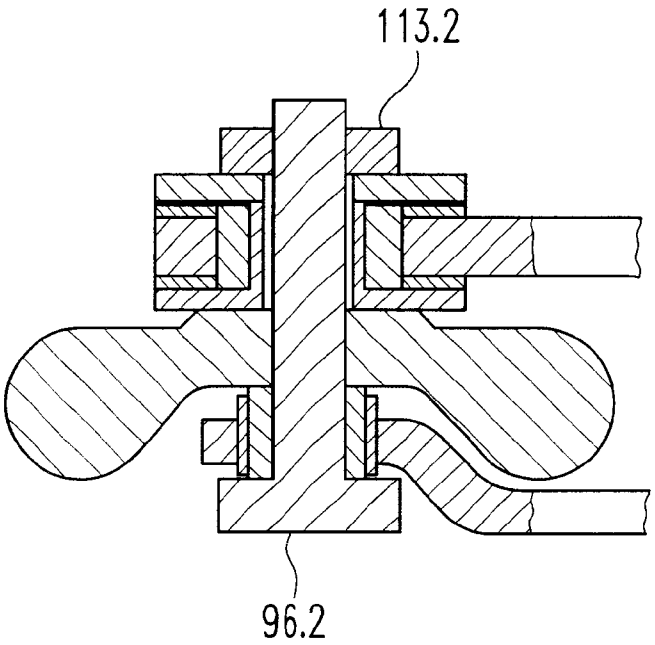
FIG. 6*b* and 6*c* are views similar to FIG. 6*a* of alternative embodiments.
Figure 6B:
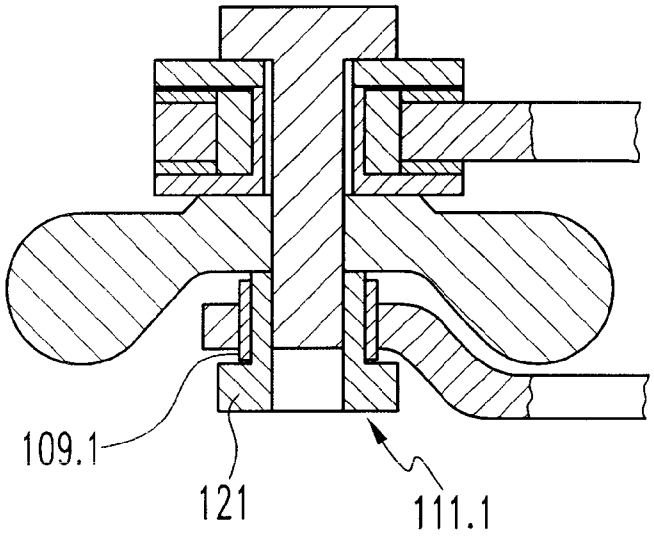

Alternative arrangement are shown in FIG. 6*b* and FIG. 6*c* where like parts have like number as in FIG. 6*a* with the addition of ".1" and ".2" respectively. In FIG. 6*b* there is no nut 113 as in FIG. 6*a*, but rather stem nut 111.1 has a head 121 replacing nut 113. In FIG. 6*c* bolt 96.2 is reversed with nut 113.2 on top.

Figure 5A:
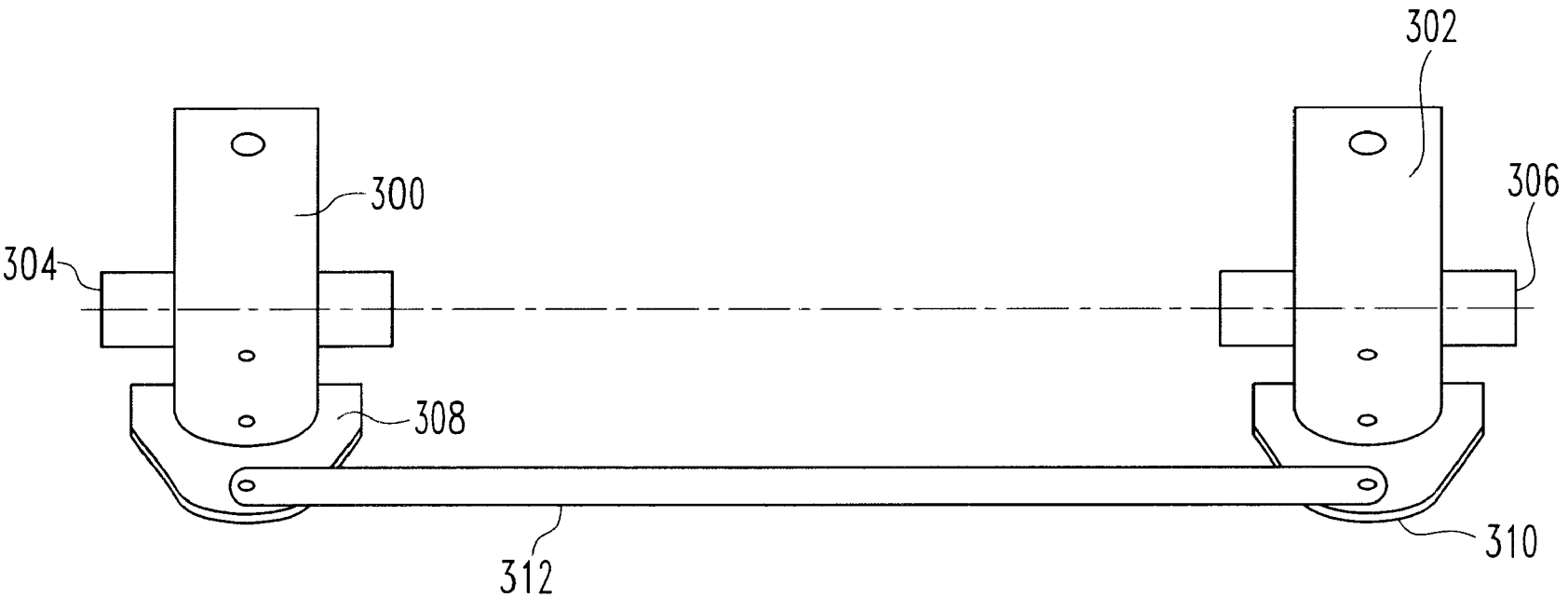
FIG. 5*a* is a view similar to FIG. 4*a* of a conventional tie-bar arrangement.
Figure 5B:
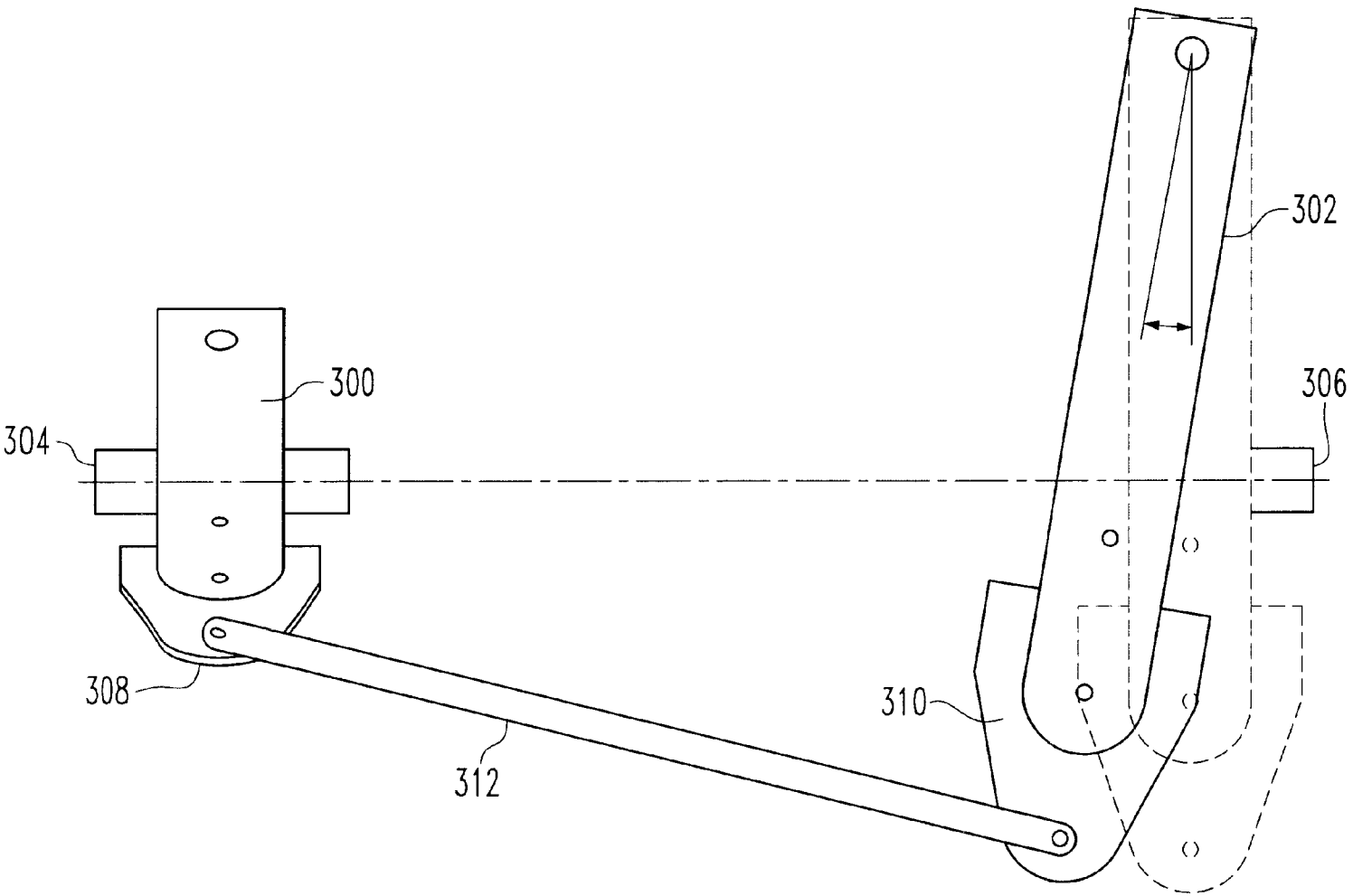
FIG. 5b (PRIOR ART)
FIG. 5*b* is a view similar to FIG. 5*a* with the right hand motor fully tilted.

A conventional tie-bar arrangement is shown in FIGS. 5*a* and 5*b* with two tillers 300 and 302. Tilt tubes 304 and 306 are also shown together with extension plates 308 and 310 connected to the tillers. Tie-bar 312 interconnects the extension plates. FIG. 5*a* shows the arrangement with both motors in the running position, while FIG. 5*b* shows the arrangement with the right motor tilted upwardly.

Figure 3B:
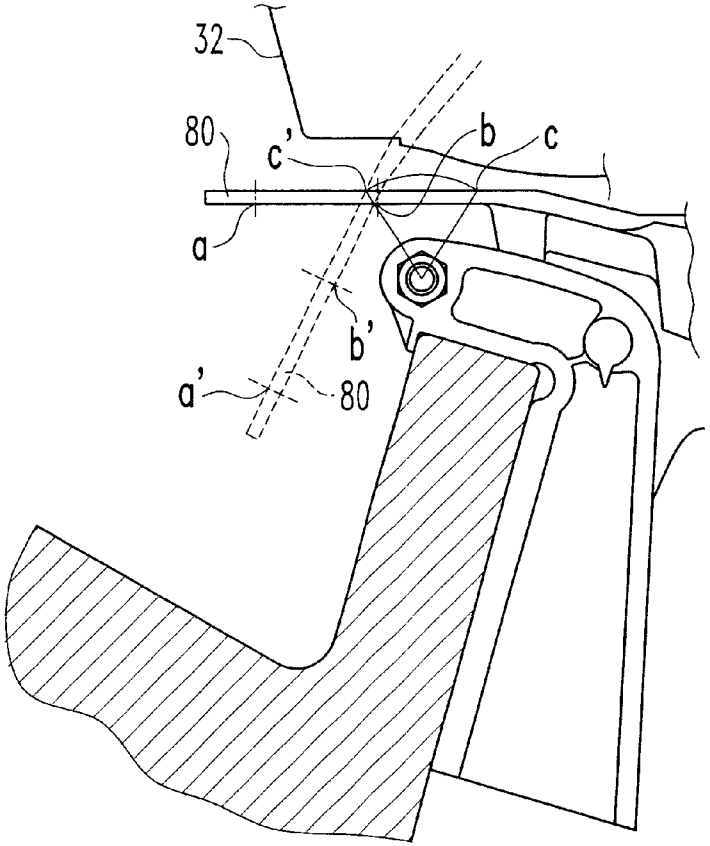
Figure 3A:
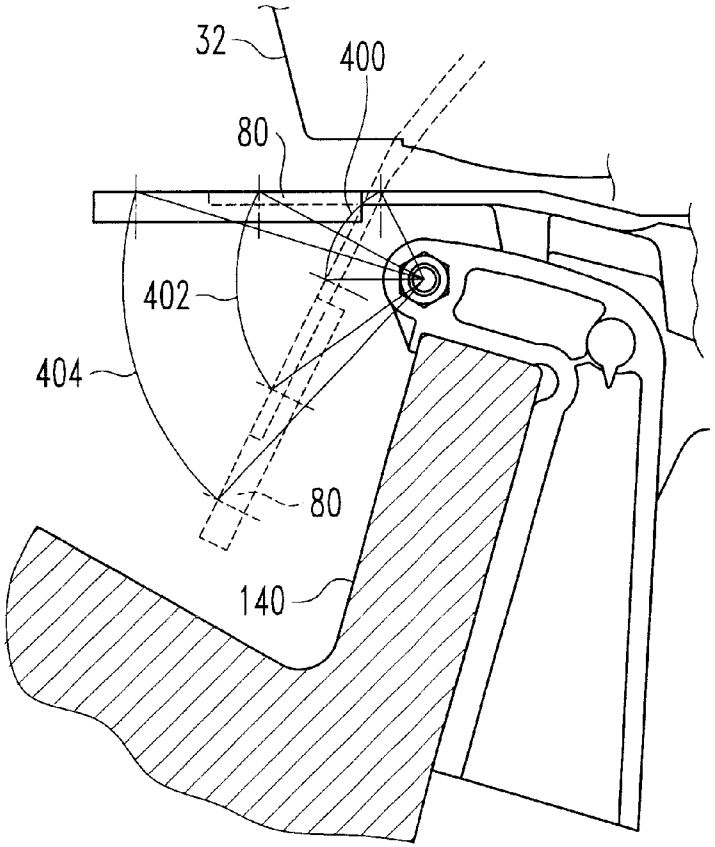
FIG. 3*a* is a simplified side view thereof with a fragment of the transom and a fragment of the motor shown in the running position.

Referring to FIG. 3*a* this is a side view of motor 32 and tiller bar 80 along with transom 140 of the boat.

Arc 400 illustrates the space required by the tie-bar 200 according to the invention, whereas arcs 402 and 404 represent older, conventional tie-bars.

The connection to the tiller arm 80.1 of the motor 33 allows the clevis to be attached to various tillers having complex cross sections as illustrated. The use of bushing 109 allows second bushing 111 to float in the vertical direction, allowing for tillers of different thicknesses, while not stressing the clevis.

Figure 7:
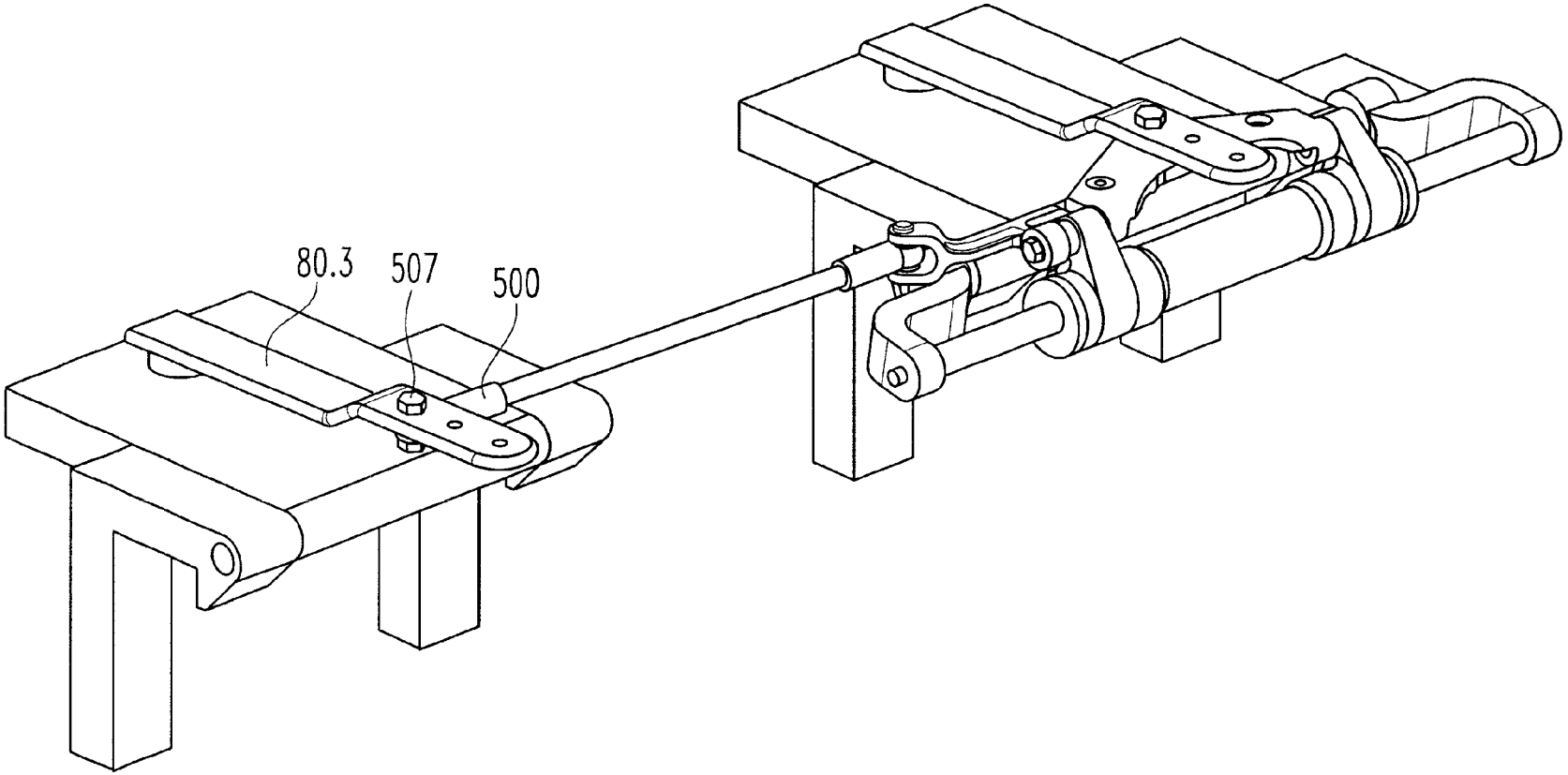
FIG. 7 is a view similar to FIG. 2 of an embodiment without a clevis and with the pivot plate mounted under the tiller.

FIG. 7 shows an alternative arrangement with a tiller 80.3 on the motor 33. In this case the clevis 105 is omitted and replaced with a single rod end coupling 500 connected to the tiller by a threaded fastener 507.

Referring to FIG. 3*b*, this shows mounting point a, which is further away from the steering axis travels further to point a' when the motor is tilted compared to point b which travels to point b'. When the motor tilts, one or both motors must toe-in to maintain the fixed length of the tie-bar. Movement from c–c' is optimum for minimum toe in but cowling interference prevents this. Movement from b–b' is according to the invention while a–a' is prior art movement.

Figure 4A:
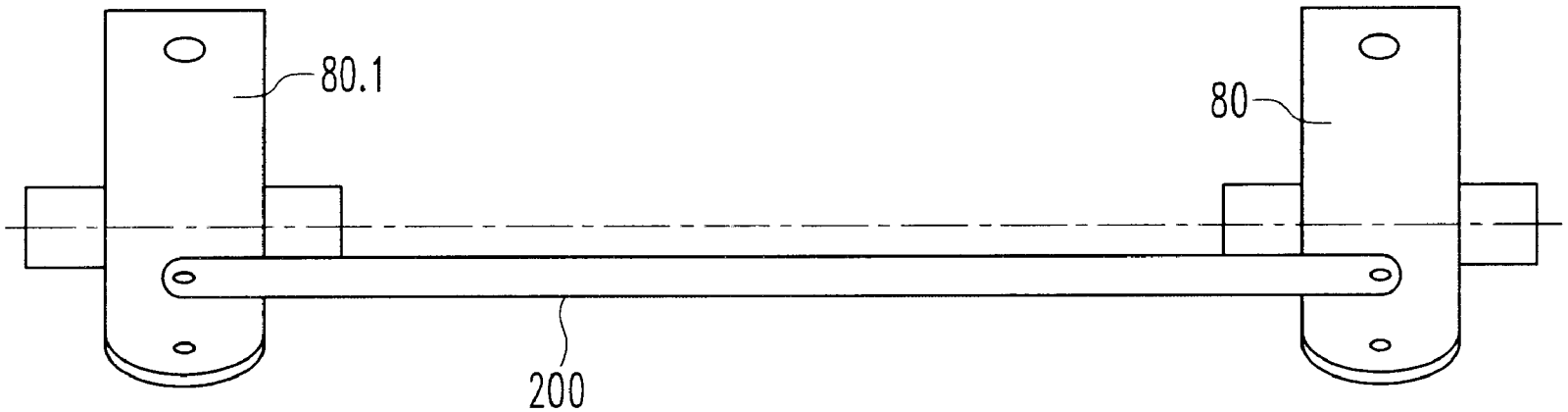
FIG. 4*a* is a simplified top, front isometric view of the tiller arms and tie bar according to an embodiment of the invention.
Figure 4B:
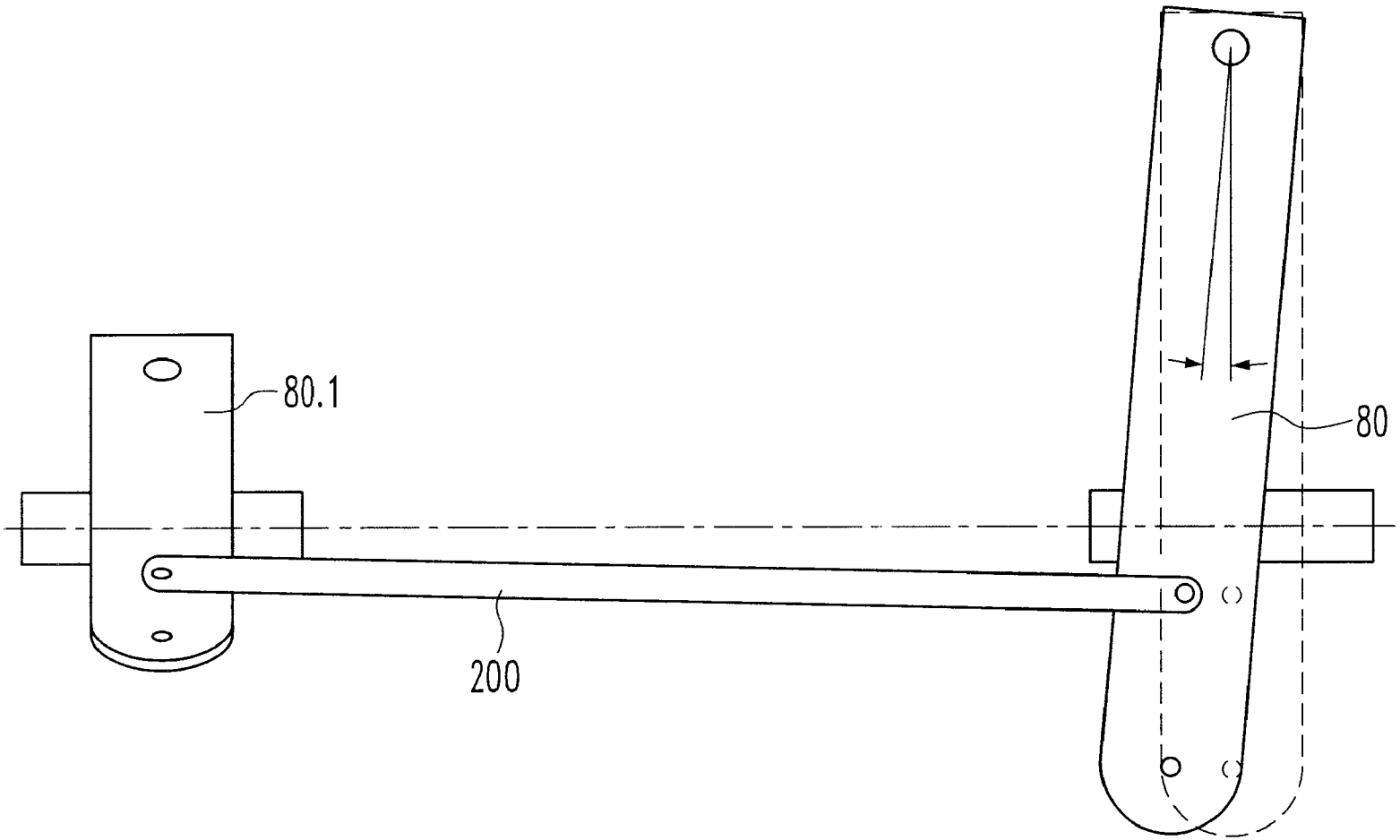
FIG. 4*b* is a side view similar to FIG. 4*a* with the right hand motor fully titled.

FIGS. 4*a* and 4*b* are simplified illustrations of the tie-bar 200 and tiller bars 80 and 80.1 according to the invention. FIG. 4*a* shows both motors at the same tilt position.

As the right motor is tilted, as shown in FIG. 4*b* for the present invention and for the prior art in FIG. 5*b*, the right motor is forced to toe in from the vertical position as may be seen by comparing the position of the tiller arms 80 and 302 in solid lines with the original positions shown in broken lines. However the amount of toe-in shown in FIG. 4*b* is significantly less than with the prior art shown in FIG. 5*b*. Large amounts of toe-in can lead to increased stress on the motor tillers if one motor touches its tiller stop before the steering cylinder hits its end stop. By reducing the amount of toe-in, the tie-bar reduces the likelihood of this happening.

The invention also helps avoid other possible interference problems by connecting the tie-bar to the pivot plate 76 instead of in front of the motor.

The invention also reduces the amount of torsion applied to the tiller. The use of a clevis on the motor 33 reduces this torsion.

It may be appreciated that many of the features described above are by way of example only and are not intended to limit the scope of the invention which is to be interpreted with reference to the following claims.

What is claimed is:

1. A hydraulic steering assembly for applying a force to tillers of two or more marine, outboard propulsion units and, accordingly, rotating each said propulsion unit about a steering axis between a center position and hard over positions to each side of the center position, the propulsion units being supported for arcuate movement about a tilt axis which is generally perpendicular to the steering axis, the steering assembly comprising:

a hydraulic steering cylinder;

an elongated piston rod reciprocatingly mounted within the cylinder for movement along a piston rod axis;

a pair of support arms which are pivotable about the tilt axis of a first said propulsion unit and are connected to the piston rod, allowing arcuate movement of the rod about the tilt axis, while maintaining the rod axis parallel to the tilt axis;

a member pivotally mounted on the tiller of said first propulsion unit for pivoting about a first link axis which is parallel to the steering axis;

a cylinder arm connected to the cylinder, which extends radially outwards from the piston rod axis, the cylinder arm being pivotally connected to the member for pivoting about a second link axis which is parallel to the piston rod axis, the cylinder arm moving through a rotational position, when the first propulsion unit rotates from the center position to either of said hard over positions, where the second link axis and the rod axis are on a plane parallel to the steering axis of the first propulsion unit; and a tie-bar pivotally connected to the member and to a second said propulsion unit.

2. A hydraulic steering assembly as claimed in claim 1, wherein the tiller of each said unit has an inner aperture and an outer aperture, the inner aperture being closer to the steering axis than the outer aperture, the member being pivotally connected at the inner aperture of the first unit and the tie-bar being connected to the inner aperture of the second unit.

3. A hydraulic steering assembly as claimed in claim 1, wherein the member is a pivot plate, the assembly including one said cylinder arm at each end of the cylinder, both cylinder arms being pivotally connected to the plate for pivoting about the second link axis.

4. A hydraulic steering assembly as claimed in claim 1, wherein the member is pivotally mounted on the tiller arm of the first unit by a pivotal connection which includes a pliable bushing.

5. A hydraulic steering assembly as claimed in claim 4, wherein the bushing is of a resilient polymer.

* * * * *